US007993429B2

(12) United States Patent
Ahlin et al.

(10) Patent No.: US 7,993,429 B2
(45) Date of Patent: Aug. 9, 2011

(54) LUBRICANT FOR POWDER METALLURGICAL COMPOSITIONS

(75) Inventors: Åsa Ahlin, Höganäs (SE); Anna Ahlquist, Höganäs (SE); Per-Olof Larsson, Helsingborg (SE); Naghi Solimnjad, Lerberget (SE)

(73) Assignee: Höganäs AB (PUBL), Höganäs (SE)

( * ) Notice: Subject to any disclaimer, the term of this patent is extended or adjusted under 35 U.S.C. 154(b) by 420 days.

(21) Appl. No.: 12/085,554

(22) PCT Filed: Dec. 6, 2006

(86) PCT No.: PCT/SE2006/001384

§ 371 (c)(1),
(2), (4) Date: Jul. 23, 2008

(87) PCT Pub. No.: WO2007/078228

PCT Pub. Date: Jul. 12, 2007

(65) Prior Publication Data

US 2009/0107292 A1 Apr. 30, 2009

Related U.S. Application Data

(60) Provisional application No. 60/754,672, filed on Dec. 30, 2005.

(30) Foreign Application Priority Data

Dec. 30, 2005 (SE) ..... 0502934

(51) Int. Cl.
*B22F 1/00* (2006.01)

(52) U.S. Cl. ..... 75/252

(58) Field of Classification Search ..... 75/252
See application file for complete search history.

(56) References Cited

U.S. PATENT DOCUMENTS

| | | | | |
|---|---|---|---|---|
| 3,516,933 | A * | 6/1970 | Andrews et al. | 508/103 |
| 5,538,684 | A * | 7/1996 | Luk et al. | 419/66 |
| 6,291,407 | B1 * | 9/2001 | Reidmeyer | 508/114 |
| 6,413,919 | B2 * | 7/2002 | Vidarsson | 508/528 |
| 6,511,945 | B1 * | 1/2003 | Ramstedt | 508/151 |
| 7,211,615 | B2 * | 5/2007 | Baumann et | 524/492 |
| 7,390,345 | B2 * | 6/2008 | Solimnjad | 75/252 |
| 2002/0146341 | A1 * | 10/2002 | Mars et al. | 419/11 |
| 2002/0183209 | A1 | 12/2002 | Jee et al. | |
| 2004/0038067 | A1 * | 2/2004 | Ozaki et al. | 428/551 |
| 2004/0119056 | A1 * | 6/2004 | Hofmann et al. | 252/500 |
| 2004/0141871 | A1 * | 7/2004 | Kondo et al. | 419/61 |

FOREIGN PATENT DOCUMENTS

| | | | |
|---|---|---|---|
| EP | 1364731 | A2 | 11/2003 |
| JP | 4056702 | A | 2/1992 |
| JP | 2005232592 | A | 9/2005 |
| JP | 2005264201 | A | 9/2005 |
| JP | 2005264201(A) | | 9/2005 |
| RU | 2254362 | | 6/2005 |
| SU | 328150 | | 7/1969 |
| SU | 969459 (A1) | | 10/1982 |
| WO | WO 94/02273 | | 2/1994 |
| WO | WO 01/40416 | A1 | 6/2001 |
| WO | WO 2006/004530 | A1 | 1/2006 |

OTHER PUBLICATIONS

Decision on Grant issued by Russian Patent Office on Dec. 22, 2010 in Russian counterpart Application No. 2008131293/02(038988) with English translation.

EPO Communication with Supplementary European Search Report dated Jun. 9, 2010.

Ozaki, Y. et al., "Pre-mixed Partially Alloyed Iron Powder for Warm Compaction: KIP Clean Mix HW Series," Kawasaki Steel Technical Report, Japan, No. 47, December 200, pp. 48-54, XP008044871.

Tremblay, L. et al., "Enhanced Green Strength Lubricating Systems for Green Machining Ferrous Materials," Advances in Powder Metallurgy & Particulate Materials, Metal Powder Industries Federation, Princeton, NJ, USA, vol. 1, Jan. 1, 1999, pp. 2141-2156, XP001112904.

Molera, P. et al., "Possible alternative lubricants for processing iron powders," Powder Metallurgy, Maney Publishing, London, GB, vol. 31, No. 4, Jan. 1, 1988, pp. 281-285, XP000006054.

* cited by examiner

*Primary Examiner* — Roy King
*Assistant Examiner* — Ngoclan Mai
(74) *Attorney, Agent, or Firm* — Buchanan Ingersoll & Rooney PC

(57) ABSTRACT

An iron-based powder metallurgical composition is provided comprising an iron or iron-based powder and a particulate composite lubricant, the composite lubricant comprising particles having a core comprising a solid organic lubricant having fine carbon particles adhered thereon. A particulate composite lubricant and a method for producing the same also are provided.

12 Claims, No Drawings

LUBRICANT FOR POWDER METALLURGICAL COMPOSITIONS

This is a 35 U.S.C. §371 filing of International Patent Application No. PCT/SE2006/001384, filed Dec. 6, 2006. The benefit is claimed under 35 U.S. §119(a)-(d) of Swedish Application No. 0502934-3, filed Dec. 30, 2005, and under 35 U.S.C. §119(e) of U.S. Provisional Application No. 60/754,672, filed Dec. 30, 2005.

The present invention relates to a powder metallurgical composition. Specifically, the invention relates to a powder metal composition comprising a new particulate composite lubricant. The invention further relates to the new particulate composite lubricant as well as a method of preparing this lubricant.

In the Powder Metallurgy industry (PM industry) powdered metals, most often iron-based, are used for production of components. The production process involves compaction of a powder metal blend in a die to form a green compact, ejecting the compact from the die and sintering the green compact at temperatures and under such conditions that a sintered compact having sufficient strength is produced. By using the PM production route costly machining and material losses can be avoided compared to conventional machining of components from solid metals as net shape or nearly net shape components can be produced. The PM production route is most suitable for the production of small and fairly intricate parts such as gears.

In order to facilitate the production of PM parts lubricants may be added to the iron-based powder before compaction. By using lubricants the internal frictions between the individual metal particles during the compaction step are reduced. Another reason for adding lubricant is that the ejection force and the total energy needed in order to eject the green part from the die after compaction are reduced. Insufficient lubrication will result in wear and scuffing at the die during the ejection of the green compact.

The problem with insufficient lubrication can be solved mainly in two ways, either by increasing the amount of lubricant or by selecting more efficient lubricants. By increasing the amount of lubricant, an undesired side effect is however encountered in that the gain in density through better lubrication is reversed by the increased amount of the lubricants.

A better choice would then be to select more efficient lubricants. This is however a problem as compounds having good lubricity in PM context tends to agglomerate during storage or contributes to agglomerate formation in the powder metallurgical composition, a consequence of which is that the subsequently compacted and sintered component may include comparatively large pores which have a detrimental effect of the static and dynamic mechanical properties of the component. Another problem is that lubricants having good lubrication properties often have negative effects on the so-called powder properties, such as flow rate and apparent density (AD). The flow rate is important because of its impact on the die filling which in turn is important for the production rate of the PM parts. A high AD is important in order to enable shorter filling depths and even AD is important in order to avoid variations in dimensions and weight of the finished components. It is thus desirable to obtain a new lubricant for powder metal compositions that overcomes or reduces the above mentioned problems.

OBJECTS OF THE INVENTION

An object of the present invention is therefore to provide a lubricant having good lubrication properties but no or reduced tendency to agglomerate.

Another object of the present invention is to provide a lubricant having good lubrication properties and yet imparting flow or improved flow properties when it is used in an iron or iron-based powder composition.

Another object is to provide a new iron or iron-based powder composition which includes the new lubricant and which has good flow properties and a high and even apparent density.

Still another object is to provide a process for producing a lubricant.

SUMMARY OF THE INVENTION

According to the invention it has now unexpectedly been found that the above objects can be met by an iron-based powder metallurgical composition comprising an iron or iron-based powder and a new particulate composite lubricant, said composite lubricant comprising particles having a core comprising a solid organic lubricant having fine carbon particles adhered thereon.

The invention also concerns the particulate composite lubricant per se as well as the preparation thereof.

DETAILED DESCRIPTION OF THE INVENTION

The type of solid organic lubricant of the composite lubricant according to the invention is not critical, but due to the disadvantages with metal-organic lubricants, the organic lubricant should preferably not include metal constituents. Thus the organic lubricant may be selected from a wide variety of organic substances having good lubricating properties. Examples of such substances are fatty acids, waxes, polymers, or derivates and mixtures thereof.

Preferred solid organic lubricants are fatty acids selected from the group consisting of palmitic acid stearic acid, behenic acid and; fatty acid monoamides selected from the group consisting of palmitamide, stearamide, behenamide, oleamide and erucamide, fatty acid bisamides, such as ethylene bisstearamide (EBS), ethylene bisoleamide (EBO), polyethylene, polyethylene wax; secondary fatty acid amides selected from the group consisting of erucyl stearamide, oleyl palmitamide, stearyl erucamide, stearyl oleamide, stearyl stearamide, oleyl stearamide.

Especially preferred solid organic lubricants are stearamide, erucamide, stearyl oleamide, erucyl stearamide, stearyl erucamide, EBO, EBS, and EBS in combination with oleamide, erucamide, stearyl oleamide stearyl erucamide or erucyl stearamide. Presently available results indicate that powder metal compositions comprising these composite lubricants according to the invention are distinguished by especially high apparent densities and/or flow rates. Additionally these lubricants are known for their excellent lubricating properties.

The average particle size of the organic core particles may be 0.5-100 μm, preferably 1-50 μm and most preferably 5-40 μm. Furthermore it is preferred that the particle size of the core is at least five times the particle size of the carbon particles and it is preferred that the fine carbon particles form a coating on the core surface.

In this context the term "fine carbon particles" is intended to mean crystalline, semi-crystalline or amorphous carbon particles. The fine carbon particles may originate from natural or synthetic graphite, carbon black, activated carbon, coal and anthracite etc and may also be a mixture of two or more of these. The fine carbon particles adhered onto the surface of the solid organic lubricant core may preferably be selected from the group consisting of carbon black and natural or synthetic graphite, having an average particle size of less than 10 μm and larger than 5 nm.

The primary particle size of the carbon black may be less than 200 nm, preferably less than 100 nm, and most preferably less than 50 nm and larger than 5 nm. The specific surface area may be between 20 and 1000 $m^2/g$ as measured by the BET-method. Carbon black may be obtained from a supplier such as Degussa AG, Germany. The content of carbon black in the composite lubricant may be 0.1-25% by weight, preferably 0.2-6% by weight and most preferably 0.5-4% by weight.

The average particle size of the graphite may be less than 10 μm and larger than 500 nm. The content of graphite in the composite lubricant may be 0.1-25% by weight, preferably 0.5-10% by weight and most preferably 1-7% by weight. Graphite may be obtained from a supplier such as Graphit Kropfmühl AG, Germany or a synthetic graphite with an ultra-high surface area from Asbury Carbons, USA.

The content of the composite lubricant in the powder metal composition may be 0.05-2% by weight.

The particulate composite lubricant according to the invention may be prepared by ordinary particle coating technique involving mixing an organic particulate lubricating material and fine carbon particles. The method may further comprise a heating step. The temperature for the heat-treatment may be below the melting point of the solid particulate organic lubricant.

The particulate solid organic lubricant may be thoroughly mixed with the fine carbon particles in a mixer. The mixer may be a high-speed mixer. The mixture may be heated during mixing at a temperature and during a time period sufficient to let the fine carbon particles adhere to the surface of the particulate organic lubricating material during a subsequently followed optional cooling step.

The iron-based powder may be a pre-alloyed iron-based powder or an iron-based powder having the alloying elements diffusion-bonded to the iron-particles. The iron-based powder may also be a mixture of essentially pure iron powder or pre-alloyed iron-based powder and alloying elements selected from the group consisting of Ni, Cu, Cr, Mo, Mn, P, Si, V, Nb, Ti, W and graphite. Carbon in the form of graphite is an alloying element used to a large extent in order to give sufficient mechanical properties to the finished sintered components. By adding carbon as an individual constituent to the iron-based powder composition the dissolved carbon content of the iron-based powder may be kept low enhancing improved compressibility. The iron-based powder may be an atomized powder, such as a water atomized powder, or a sponge iron powder. The particle size of the iron-based powder is selected depending on the final use of the material. The particles of the iron or iron-based powder may have a weight average particle size of up to about 500 μm, more preferably the particles may have a weight average particle size in the range of 25-150 μm, and most preferably 40-100 μm.

The powder metal composition may further comprise one or more additives selected from the group consisting of binders, processing aids, hard phases, machinability enhancing agents if there is a need of machining of the sintered component, and solid lubricants conventionally used in PM-industry such as EBS, zinc-stearate and Kenolube® available from Höganäs AB. The concentration of the powdered composite lubricant according to the invention plus optional solid lubricants may be in the range of 0.05 to 2% of a powder metal composition.

The new iron or iron-based powder composition may be compacted and optionally sintered by conventional PM techniques.

The following examples serve to illustrate the invention but the scope of the invention should not be limited thereto.

EXAMPLES

Materials

The following materials were used.

(1) As iron-based water atomized powder (ASC100.29, available from Höganäs AB, Sweden) was used.

(2) As lubricating core materials the following substances were used; ethylene bis-stearamide (EBS) available as Licowax™ from Clariant (Germany), stearamide, erucamide, oleyl palmitamide, stearyl oleylamide, erucyl stearamide, stearyl erucamide, ethylene bis-oleamide (EBO) and polyethylene waxes. The average particle sizes of the lubricants can be seen in Table 2.

(3) Graphite UF-4 (from Graphit Kropfmühl AG, Germany) was used as added graphite in the iron-based powder composition.

(4) Coating particles were Graphite UF-1 (UF1) (from Graphit Kropfmühl AG, Germany) and Graphite 4827 (4827) (from Asbury Carbons, USA) having an average particle size of 2 μm and 1.7 μm respectively, and Carbon black (CB) (from Degussa AG, Germany) having a primary particle size of 30 nm.

The iron-based powder compositions consisted of ASC100.29 mixed with 0.5% by weight of graphite and 0.8% by weight of composite lubricant.

Different composite lubricants were prepared by mixing core material according to Table 1 and 2 with fine carbon particles at different concentrations in a high-speed mixer from Hosokawa. Carbon black was added at the concentrations of 0.75, 1.5, 3 and 4% by weight, respectively. Graphite was added at the concentrations of 1.5, 3, 5 and 6% by weight, respectively to the composite lubricants. The process parameters for the mixing process, such as temperature of the powder in the mixer and the mixing times for each composite can be seen in Table 2. The rotor speed in the mixer was 1000 rpm and the amount of lubricant core material was 500 g.

TABLE 1

Lubricating substances used as core materials.

| Mark | Common name |
|---|---|
| ES | Erucyl stearamide |
| OP | Oleyl palmitamide |
| S | Stearamide |
| O | Oleamide |
| E | Erucamide |
| EBS | Ethylene bis-stearamide |
| PW655 | Polyethylene wax |
| PW1000 | Polyethylene wax |
| SE | Stearyl erucamide |
| EBO | Ethylene bis-oleamide |
| SO | Stearyl oleamide |

TABLE 2

| Process parameters | | | |
|---|---|---|---|
| Mark | Average particle size X50 (μm) | Temp. of powder in the mixer (° C.) | Mixing time (min) |
| S-1 | 5.2 | 50° C. | 25 |
| S-2 | 5.8 | 50° C. | 25 |
| S-3 | 15.4 | 50° C. | 25 |
| S-4 | 16.5 | 50° C. | 45 |
| S-5 | 17.8 | 50° C. | 25 |
| S-6 | 21.5 | 50° C. | 25 |
| S-7 | 4.0 | 83° C. | 60 |
| ES-1 | 24.0 | 25° C. | 25 |
| ES-2 | 29.5 | 25° C. | 25 |
| E | 20.3 | 25° C. | 45 |
| OP | 16.0 | 25° C. | 45 |
| EBS | 8.5 | 75° C. | 55 |
| EBS/O | 25.6 | 40° C. | 20 |
| PW655 | 10.0 | 25° C. | 45 |
| PW1000 | 10.0 | 40° C. | 45 |
| SE | 27.4 | 25° C. | 45 |
| SO | 35.4 | 25° C. | 45 |
| EBS/SE | 29.0 | 25° C. | 45 |
| EBS/SO | 29.2 | 25° C. | 45 |
| EBS/ES | 20.4 | 25° C. | 45 |
| EBS/E | 26.0 | 25° C. | 15 |
| S/E | 24.3 | 25° C. | 45 |
| EBO | 16.0 | 50° C. | 10 |

Different iron-based powder compositions (mix no 1-63) of 25 kg each were prepared by mixing the obtained composite lubricant or a conventional particulate lubricant (used as reference) with graphite and ASC100.29 in a 50 kg Nauta mixer The solid organic lubricant particles in mixes no 36-38 and 50-61 were melted, subsequently solidified and micronised before used as a core material for preparing the composite lubricants or before added to the reference mixes. Apparent density (AD) and Hall flow (flow), were measured, according to ISO 4490 and ISO3923-1, respectively, on the obtained iron-based powder compositions 24 hours after the mixing. Table 3 shows the results of the measurements.

As can be seen from table 3, the flow rate of the iron-based powder compositions is improved and higher apparent densities may be obtained when using the different composite lubricants according to the invention as lubricants compared with the use of a conventional lubricant. In fact, when a PM composition containing a conventional lubricant has no flow the PM composition containing the inventive composite lubricant provides flow. Especially high apparent densities and/or flow rates were obtained for powder metal compositions containing composite lubricants according to the invention containing stearamide, erucamide, erucyl stearamide, stearyl erucamide, EBO, EBS and EBS in combination with oleamide or stearyl erucamide.

In order to measure the tendency of the composite lubricants and the conventional lubricants to form agglomerates the lubricants were sieved on a standard 315 μm sieve after storage of at least one week. The amount of the retained material was measured.

Table 4 shows that the tendency of forming agglomerates decreases when the organic lubricating core material is covered by fine carbon particles resulting in a composite lubricant according to the invention.

The same type of measurements as shown in table 4 was repeated with certain iron-based powder compositions in order to evaluate the tendency of forming agglomerates in an iron-based powder composition containing conventional lubricants and composite lubricants according to the invention, respectively.

Table 5 shows that the tendency of forming agglomerates is less pronounced in iron-based powder compositions containing the composite lubricant according to the invention compared with compositions comprising a conventional lubricant.

TABLE 3

| Flow rate and apparent density (AD) of compositions 1-63 | | | | | | |
|---|---|---|---|---|---|---|
| Mix no | Conventional lubricant used as reference | Core of lubricating composite | Type of Carbon particles adhered onto lubricating core material | Percentage of carbon particles in relation to total amount of lubricating composite (%) | Flow (seconds/50 g) | AD (g/cm3) |
| 1 | S-1 | | | | No flow | 2.97 |
| 2 | | S-1 | UF1 | 3.0 | No flow | 2.99 |
| 3 | | S-1 | CB | 1.5 | 34.5 | 2.85 |
| 4 | | S-1 | CB | 3.0 | 30.4 | 2.92 |
| 5 | S-2 | | | | No flow | 2.98 |
| 6 | | S-2 | UF1 | 3.0 | No flow | 2.99 |
| 7 | | S-2 | CB | 3.0 | 32.9 | 2.91 |
| 8 | S-3 | | | | No flow | 3.05 |
| 9 | | S-3 | UF1 | 3.0 | 29.5 | 3.17 |
| 10 | S-4 | | | | No flow | 3.12 |
| 11 | | S-4 | UF1 | 3.0 | 28.3 | 3.18 |
| 12 | | S-4 | CB | 0.75 | 27.1 | 3.21 |
| 13 | | S-4 | CB | 1.5 | 27.2 | 3.17 |
| 14 | S-5 | | | | 30.6 | 3.05 |
| 15 | | S-5 | CB | 0.75 | 28.5 | 3.13 |
| 16 | | S-5 | CB | 1.5 | 27.3 | 3.13 |
| 17 | | S-5 | 4827 | 5.0 | 29.3 | 3.17 |
| 18 | S-6 | | | | 31.5 | 3.06 |
| 19 | | S-6 | UF1 | 3.0 | 27.7 | 3.20 |
| 20 | | S-6 | CB | 0.75 | 26.9 | 3.21 |
| 21 | S-7 | | | | 28.2 | 3.17 |
| 22 | | S-7 | UF1 | 3.0 | 26.1 | 3.19 |
| 23 | | S-7 | CB | 3.0 | 26.0 | 3.11 |
| 24 | ES-1 | | | | No flow | 3.10 |
| 25 | | ES-1 | CB | 1.5 | 33.1 | 3.19 |
| 26 | ES-2 | | | | No flow | 3.13 |
| 27 | | ES-2 | CB | 1.5 | 31.3 | 3.15 |

TABLE 3-continued

Flow rate and apparent density (AD) of compositions 1-63

| Mix no | Conventional lubricant used as reference | Core of lubricating composite | Type of Carbon particles adhered onto lubricating core material | Percentage of carbon particles in relation to total amount of lubricating composite (%) | Flow (seconds/ 50 g) | AD (g/cm3) |
|---|---|---|---|---|---|---|
| 28 | | ES-2 | 4827 | 1.5 | 29.7 | 3.18 |
| 29 | E | | | | No flow | 3.03 |
| 30 | | E | CB | 1.5 | 30.3 | 2.97 |
| 31 | | E | CB | 3.0 | 28.8 | 3.01 |
| 32 | OP | | | | No flow | 2.92 |
| 33 | | OP | CB | 1.5 | 34.3 | 2.94 |
| 34 | EBS | | | | 33.5 | 3.01 |
| 35 | | EBS | CB | 1.5 | 30.8 | 3.00 |
| 36 | EBS/O | | | | 31.0 | 3.03 |
| 37 | | EBS/O | UF1 | 3.0 | 30.4 | 3.10 |
| 38 | | EBS/O | CB | 3.0 | 28.4 | 3.09 |
| 39 | PW655 | | | | No flow | 2.76 |
| 40 | | PW655 | CB | 1.5 | 32.1 | 2.82 |
| 41 | PW1000 | | | | No flow | 2.78 |
| 42 | | PW1000 | CB | 1.5 | 32.5 | 2.85 |
| 43 | Zn-stearat | | | | 35.4 | 3.18 |
| 44 | SE | | | | No flow | 2.96 |
| 45 | | SE | CB | 3.0 | 29.9 | 3.11 |
| 46 | | SE | UF1 | 6.0 | 31.2 | 3.08 |
| 47 | | SE | 4827 | 5.0 | 30.4 | 3.10 |
| 48 | SO | | | | No flow | 2.95 |
| 49 | | SO | CB | 1.5 | 30.9 | 2.98 |
| 50 | EBS/SE | | | | No flow | 2.98 |
| 51 | | EBS/SE | CB | 1.5 | 29.6 | 3.17 |
| 52 | EBS/SO | | | | No flow | 2.95 |
| 53 | | EBS/SO | CB | 1.5 | 30.9 | 3.03 |
| 54 | EBS/ES | | | | No flow | 3.00 |
| 55 | | EBS/ES | CB | 1.5 | 33.4 | 2.99 |
| 56 | EBS/E | | | | No flow | 2.96 |
| 57 | | EBS/E | CB | 1.5 | 30.0 | 3.03 |
| 58 | S/E | | | | No flow | 3.00 |
| 59 | | S/E | CB | 4.0 | 29.1 | 3.16 |
| 60 | | S/E | UF1 | 6.0 | 28.4 | 3.17 |
| 61 | | S/E | 4827 | 5.0 | 28.2 | 3.18 |
| 62 | EBO | | | | No flow | 2.95 |
| 63 | | EBO | CB | 3.0 | 34.0 | 3.04 |

TABLE 4

Tendency of forming agglomerates for conventional lubricants and lubricating composites according to the invention

| Conventional lubricant | Core material of lubricating composite | Type of Carbon particles adhered onto lubricating core material | Percentage of carbon particles in relation to total amount of lubric composite (%) | Tendency of forming agglomerates |
|---|---|---|---|---|
| S-1 | | | | Aggl |
| | S-1 | CB | 1.5 | Less aggl |
| | S-1 | CB | 3.0 | Less aggl |
| S-2 | | | | Aggl |
| | S-2 | CB | 3.0 | Less aggl |
| S-4 | | | | Aggl |
| | S-4 | UF1 | 3.0 | No aggl |
| | S-4 | CB | 0.75 | No aggl |
| | S-4 | CB | 1.5 | No aggl |
| S-5 | | | | Aggl |
| | S-5 | CB | 0.75 | No aggl |
| | S-5 | CB | 1.5 | No aggl |
| | S-5 | 4827 | 5.0 | No aggl |
| S-7 | | | | Aggl |
| | S-7 | UF1 | 3.0 | No aggl |
| | S-7 | CB | 0.75 | No aggl |
| ES-2 | | | | Aggl |
| | ES-2 | CB | 1.5 | No aggl |
| | ES-2 | 4827 | 1.5 | No aggl |

TABLE 4-continued

Tendency of forming agglomerates for conventional lubricants and lubricating composites according to the invention

| Conventional lubricant | Core material of lubricating composite | Type of Carbon particles adhered onto lubricating core material | Percentage of carbon particles in relation to total amount of lubric composite (%) | Tendency of forming agglomerates |
|---|---|---|---|---|
| E | | | | Aggl |
| | E | CB | 1.5 | Less aggl |
| OP | | | | Aggl |
| | OP | CB | 1.5 | No aggl |
| EBS | | | | No aggl |
| | EBS | CB | 1.5 | No aggl |
| EBS/O | | | | No aggl |
| | EBS/O | UF1 | 3.0 | No aggl |
| SE | | | | Aggl |
| | SE | CB | 1.5 | No aggl |
| | SE | UF1 | 6.0 | No aggl |
| | SE | 4827 | 5.0 | No aggl |
| SO | | | | Aggl |
| | SO | CB | 1.5 | No aggl |
| EBS/SE | | | | Aggl |
| | EBS/SE | CB | 1.5 | No aggl |
| EBS/SO | | | | Aggl |
| | EBS/SO | CB | 1.5 | No aggl |
| EBS/ES | | | | Aggl |
| | EBS/ES | CB | 1.5 | No aggl |
| EBS/E | | | | Aggl |
| | EBS/E | CB | 1.5 | No aggl |
| S/E | | | | Aggl |
| | S/E | CB | 4.0 | No aggl |
| | S/E | UF1 | 6.0 | No aggl |
| | S/E | 4827 | 5.0 | No aggl |
| EBO | | | | Aggl |
| | EBO | CB | 3.0 | No aggl |

TABLE 5

Tendency of forming agglomerates in iron-based powder compositions containing conventional lubricants and the composite lubricant according to the invention

| Mix no | Conventional lubricant | Core material of composite lubricant | Type of carbon particles adhered onto lubricating core material | Percentage of carbon particles in relation to total amount of lubricating composite (%) | Tendency of forming agglomerates |
|---|---|---|---|---|---|
| 1 | S-1 | | | | Aggl |
| 3 | | S-1 | CB | 1.5 | No aggl |
| 4 | | S-1 | CB | 3.0 | No aggl |
| 5 | S-2 | | | | Aggl |
| 7 | | S-2 | CB | 3.0 | No aggl |
| 24 | ES-1 | | | | Aggl |
| 25 | | ES-1 | CB | 1.5 | No aggl |
| 29 | E | | | | Aggl |
| 30 | | E | CB | 1.5 | Less aggl |
| 31 | | E | CB | 3 | No aggl |
| 32 | OP | | | | Aggl |
| 33 | | OP | CB | 1.5 | No aggl |
| 34 | EBS | | | | No aggl |
| 35 | | EBS | CB | 1.5 | No aggl |
| 39 | PW655 | | | | Aggl |
| 40 | | PW655 | CB | 1.5 | No aggl |
| 41 | PW1000 | | | | Aggl |
| 42 | | PW1000 | CB | 1.5 | No aggl |
| 43 | Zn-stearate | | | | No aggl |
| 44 | SE | | | | Aggl |
| 45 | | SE | CB | 1.5 | No aggl |
| 46 | | SE | UF1 | 6.0 | No aggl |
| 47 | | SE | 4827 | 5.0 | No aggl |
| 48 | SO | | | | Aggl |
| 49 | | SO | CB | 1.5 | No aggl |
| 50 | EBS/SE | | | | Aggl |
| 51 | | EBS/SE | CB | 1.5 | No aggl |

TABLE 5-continued

Tendency of forming agglomerates in iron-based powder compositions containing conventional lubricants and the composite lubricant according to the invention

| Mix no | Conventional lubricant | Core material of composite lubricant | Type of carbon particles adhered onto lubricating core material | Percentage of carbon particles in relation to total amount of lubricating composite (%) | Tendency of forming agglomerates |
|---|---|---|---|---|---|
| 52 | EBS/SO | | | | Aggl |
| 53 | | EBS/SO | CB | 1.5 | No aggl |
| 54 | EBS/ES | | | | Aggl |
| 55 | | EBS/ES | CB | 1.5 | No aggl |
| 56 | EBS/E | | | | Aggl |
| 57 | | EBS/E | CB | 1.5 | No aggl |
| 58 | S/E | | | | Aggl |
| 59 | | S/E | CB | 4.0 | No aggl |
| 60 | | S/E | UF1 | 6.0 | No aggl |
| 61 | | S/E | 4827 | 5.0 | No aggl |
| 62 | EBO | | | | Aggl |
| 63 | | EBO | CB | 3.0 | No Aggl |

The invention claimed is:

1. Iron-based powder metallurgical composition comprising an iron or iron-based powder and a particulate composite lubricant, said composite lubricant comprising particles having a core comprising a solid organic lubricant having fine carbon particles adhered thereon.

2. Composition according to claim 1, wherein the carbon particles are selected from natural or synthetic graphite, carbon black, activated carbon, coal and anthracite.

3. Composition according to claim 1, wherein the carbon particles are selected from natural or synthetic graphite and carbon black.

4. Composition according to claim 1, wherein the carbon particles form a coating on the core.

5. Composition according to claim 1, wherein the organic core particles are selected from the group consisting of fatty acids, waxes, polymers, or derivates and mixtures thereof.

6. Composition according to claim 1, wherein the average particle size of the organic core particles is 0.5-100 μm.

7. Composition according to claim 1, wherein the content of the composite lubricant in the powder metal composition is 0.05-2% by weight.

8. Composition according to claim 1, wherein the particle size of the core is at least five times the particle size of the carbon particles.

9. Composition according to claim 2, wherein the particle size of the carbon black is less than 200 nm.

10. Composition according to claim 2, wherein the content of carbon black in the composite lubricant is 0.1-25% by weight.

11. Composition according to claim 2, wherein the average particle size of the graphite is less than 10 μm.

12. Composition according to claim 2, wherein the content of graphite in the composite lubricant is 0.1-25% by weight.

* * * * *